US007223148B2

(12) United States Patent
Yang

(10) Patent No.: US 7,223,148 B2
(45) Date of Patent: May 29, 2007

(54) METHOD OF FABRICATING TETRA-POLAR FIELD-EMISSION DISPLAY

(75) Inventor: Frank Yang, Guanyin Township, Taoyuan County (TW)

(73) Assignee: TECO Nanotech Co., Ltd., Taoyuan (TW)

( * ) Notice: Subject to any disclaimer, the term of this patent is extended or adjusted under 35 U.S.C. 154(b) by 122 days.

(21) Appl. No.: 10/934,593

(22) Filed: Sep. 3, 2004

(65) Prior Publication Data

US 2005/0239364 A1 Oct. 27, 2005

(30) Foreign Application Priority Data

Apr. 23, 2004 (TW) ..... 93111424 A

(51) Int. Cl.
*H01J 9/00* (2006.01)

(52) U.S. Cl. ..... 445/24; 445/25

(58) Field of Classification Search ..... 445/24–25; 313/495–497, 306–311
See application file for complete search history.

(56) References Cited

U.S. PATENT DOCUMENTS 6,359,383 B1 * 3/2002 Chuang et al. ..... 313/496
6,803,708 B2 * 10/2004 Simon et al. ..... 313/311
6,995,502 B2 * 2/2006 Hwu et al. ..... 313/293
2003/0113450 A1 * 6/2003 Park et al. ..... 427/255.28
2004/0227452 A1 * 11/2004 Lee et al. ..... 313/495
2005/0264164 A1 * 12/2005 Cheng ..... 313/495

* cited by examiner

*Primary Examiner*—Mariceli Santiago
*Assistant Examiner*—Anne M Hines

(57) ABSTRACT

A method of fabricating a tetra-polar field-emission display, using a shadow mask to form an opening of a converging electrode, so as to improve converging effect of an electron beam propagating through the opening. An anode electrode structure and a cathode electrode structure are formed. The cathode electrode structure includes a first dielectric layer, a gate layer, a second dielectric layer and a converging layer on a substrate. The converging layer, the second dielectric layer, the gate layer and the first dielectric layer are patterned to form a window exposing the substrate. A cathode electrode layer is formed on the substrate exposed by the window. The converging layer is patterned into n converging electrode having a top surface, a bottom surface, and a pair of side surfaces. The side surfaces are so configured that the window is gradually reduced from the top surface towards a turning point between the top surface and the bottom surface, and then gradually enlarged from the turning point towards the bottom surface.

9 Claims, 8 Drawing Sheets

METHOD OF FABRICATING TETRA-POLAR FIELD-EMISSION DISPLAY

BACKGROUND OF THE INVENTION

The present invention relates in general to a field-emission display, and more particularly, to a method for configuring an opening of a shadow masking converging electrode of a tetra-polar field-emission display, so as to optimize the converging effect.

FIG. 1 shows a converging electrode of a conventional tetra-polar field-emission display. As shown, a substrate 11*a* having an anode electrode structure formed thereon is provided. The anode electrode structure has a first conductive layer 12*a* and a second conductive layer 13*a* enclosing the first conductive layer 12*a* therein. The first and second conductive layers 12*a* and 13*a* serves as the electrode layer 14*a* on which electron beams will impinge, so as to generate light. The field-emission display further includes a cathode electrode structure, which comprises a substrate 21*a*, a first insulating layer 22*a* on the substrate 21*a*, a gate conductive layer 23*a* on the first insulating layer 22*a*, a second insulating layer 24*a* on the gate conductive layer 23*a*, and a converging layer on the second insulating layer 24*a*. The converging layer 25*a*, the second insulating layer 24*a*, the gate conductive layer 23*a*, and the first insulating layer 22*a* are patterned to form a window 26*a* from which the substrate 21*a* is exposed. The area of substrate exposed by the window 26*a* is denoted by the numeral reference 27*a* as shown in FIG. 1. A first conductive layer 28*a* is then formed on the exposed substrate 26*a*, and a second conductive layer 29*a* is formed on the first conductive layer 28*a*, such that a gate electrode layer 30*a* is formed as shown.

The above structure is formed using a metal shadow mask, and the gate conductive layer 23*a* is formed with a specific thickness between about 50 microns to about 200 microns, which is relative thick compared to the converging electrode fabricated by photolithography or screen printing process. The metal shadow mask is advantageous on mass production, however, it has the following drawbacks in addition to the relative thick feature.

Firstly, the electron beam starts diffusing after being drained by the gate layer. Therefore, the thicker the converging layer is, the longer path the electron beam is to propagate through the converging electrode. As a result, a portion of the electrons is absorbed by the converging electrode, such that the current density is reduced.

Secondly, to avoid the loss of the electron beam, the opening of the converging electrode is designed larger than the opening of the gate layer. Thereby, the space between the apertures of the gate shadow mask is reduced, and it is difficult to implement high-resolution array.

Thirdly, when the opening of the converging electrode is larger than that of the gate layer, higher voltage is required for the converging electrode for converging the electron beam.

It is therefore a substantially need to provide a method for fabricate a field-emission display of which the absorption of electron beam by the converging electrode is reduced, which the voltage provided to the converging electrode is not increased.

BRIEF SUMMARY OF THE INVENTION

To resolve the above drawbacks, a tetra-polar field-emission display is provided. The field-emission display has a redesigned opening of a converging electrode, such that the converging effect is optimized without causing loss of the electron beam.

A method of fabricating a tetra-polar field-emission display is provided. A shadow mask is used to form an opening of a converging electrode, so as to improve converging effect of an electron beam propagating through the opening. An anode electrode structure and a cathode electrode structure are formed. The cathode electrode structure includes a first dielectric layer, a gate layer, a second dielectric layer and a converging layer on a substrate. The converging layer, the second dielectric layer, the gate layer and the first dielectric layer are patterned to form a window exposing the substrate. A cathode electrode layer is formed on the substrate exposed by the window. The converging layer is patterned into n converging electrode having a top surface, a bottom surface, and a pair of side surfaces. The side surfaces are so configured that the window is gradually reduced from the top surface towards a turning point between the top surface and the bottom surface, and then gradually enlarged from the turning point towards the bottom surface.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
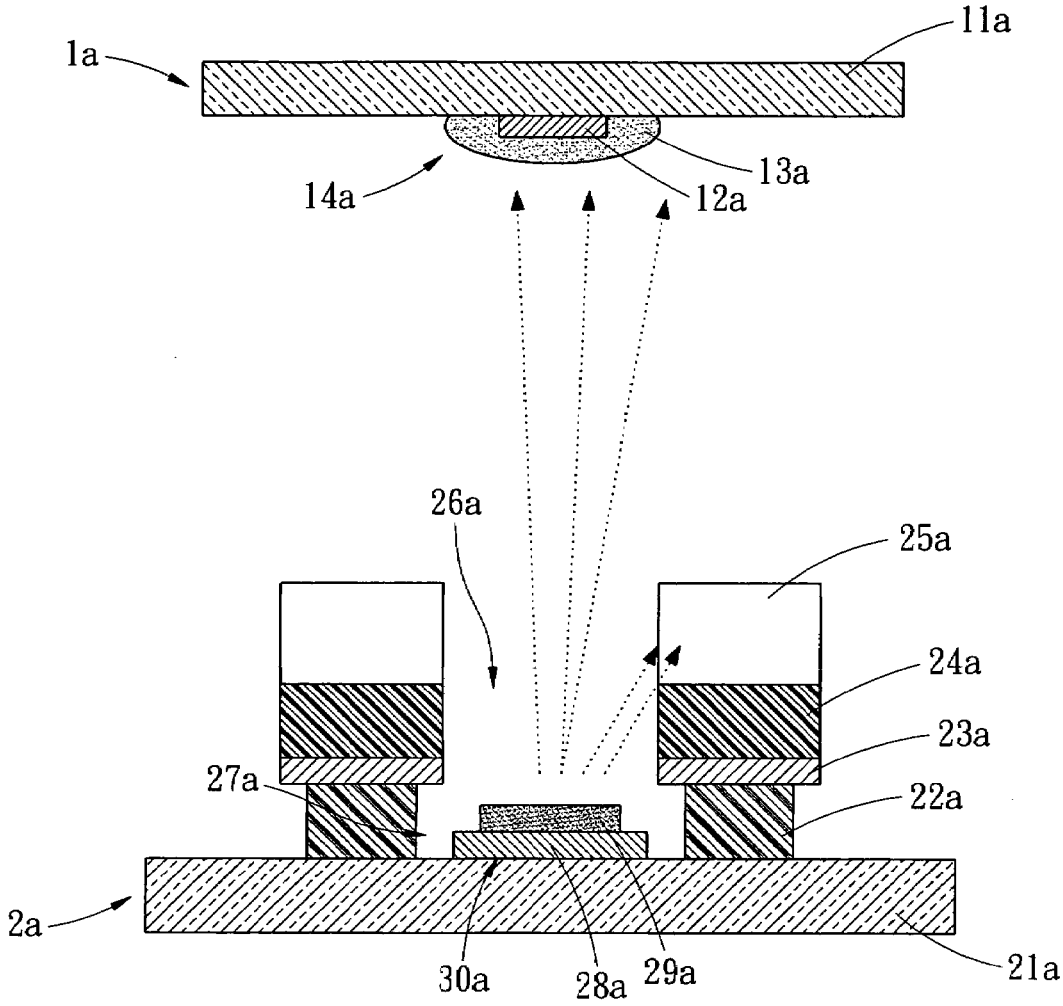
FIG. 1 PRIOR ART
FIG. 1 shows a conventional tetra-polar field-emission display.
Figure 2:
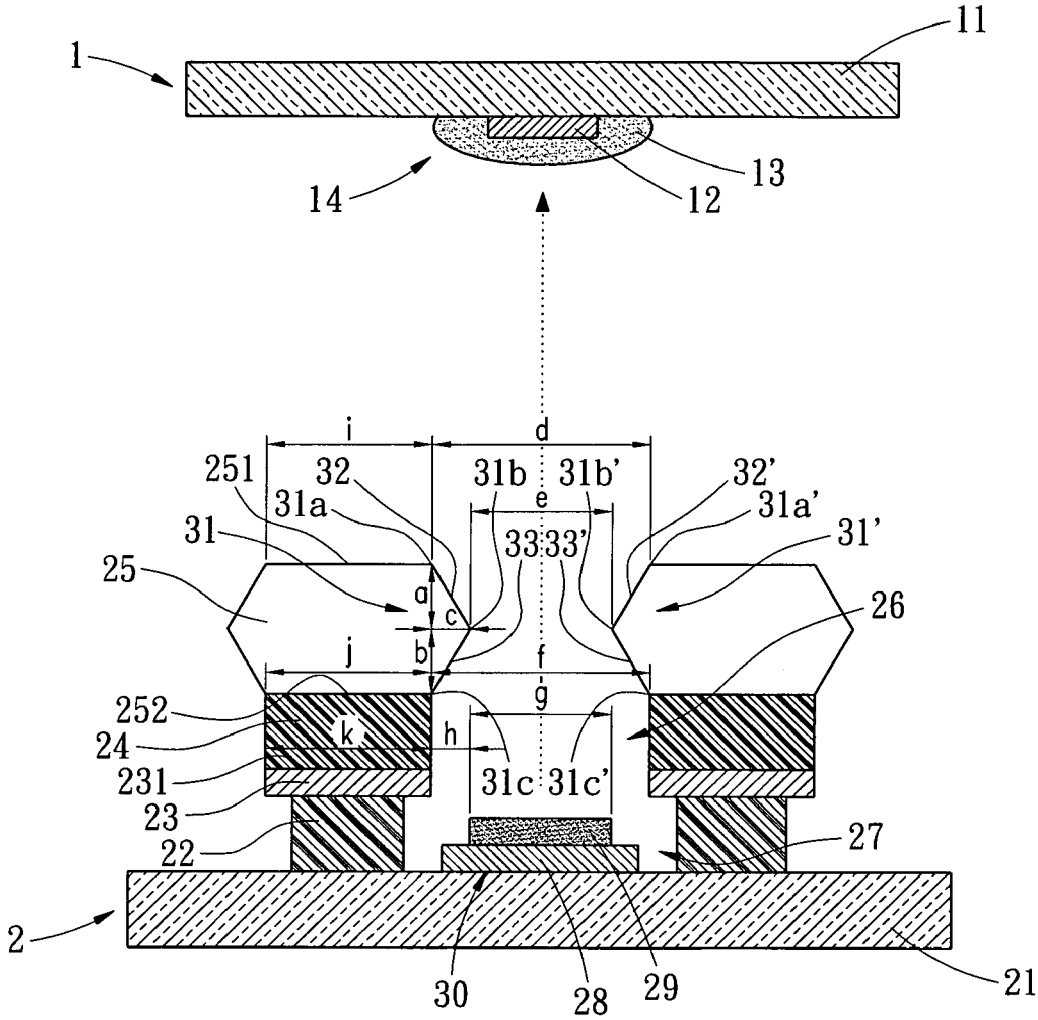
FIG. 2 shows an embodiment of a tetra-polar field-emission display.

Referring to FIG. 2, a tetra-polar field-emission display as provided comprises an anode electrode structure 1 and a cathode electrode structure 2 aligned with the anode electrode structure 1. In the tetra-polar field-emission display, the converging electrode is fabricated from shadow mask process, such that the converging effect can be optimized.

The anode electrode structure 1 includes a substrate 11, a first conductive layer 12 formed on the substrate 11, and a second conductive layer 13 formed on the first conductive layer 12. The first conductive layer 12 includes an indium tin oxide (ITO) layer, and the second conductive layer 13 includes a phosphor layer, for example. Therefore, an electron beam impinges on the anode electrode layer 14 comprising the first and second conductive layers 12 and 13 can generate light therefrom.

The cathode electrode structure 2 includes a substrate 21, a first insulating or dielectric layer 22 formed on the substrate 21, a gate conductive layer 23 formed on the first dielectric layer 22, a second dielectric layer 24 formed on the gate conductive layer 23, and a converging (focusing) layer 25 formed on the second dielectric layer 24. The substrate 21 is fabricated from glass material, for example. The converging layer 25, the second dielectric layer 24, the gate conductive layer 23, and the first dielectric layer 22 are patterned to form a window 26 which exposes a portion of the substrate 21. The area of the window 26 is denoted as the reference number 27 as shown in FIG. 2. A first conductive layer 28 such as a silver paste is formed on the exposed substrate e21 in the area 27. A second conductive layer 29 is then formed on the first conductive layer 28. The second conductive layer 29 is preferably formed of carbon nanotube by spray coating or photolithography. The first and second conductive layers 28 and 29 form a cathode electrode layer 30 of the cathode electrode structure 2.

The converging layer 25 is patterned to form a pair of lateral protrusions 31 and 31' extending towards the window 26. The protrusion 31 has two slanted side surfaces 32 and 33 extending from the top and bottom corners 31*a* and 31*c* to merge at the tip 31*b*, and the protrusion 31' has two slanted side surfaces 32' and 33' extending from the top and bottom corners 31*a*' and 31*c*' to merge at the tip 31*b*'. In this embodiment, the protrusions 31 an 31' are in the form of triangles having bottom sides extending between the top and bottom corners 31*a* and 31*c* and 31*a*' and 31*c*', respectively, and top angles 31*b* and 31*b*' pointing at each other above the area 27 within the window 26. That is, the converging layer 25 is patterned into a plurality of converging electrodes in the form of a hexagon, which comprising two side triangle portions extending towards the windows 26. As shown in FIG. 2, the thickness of the converging layer 25 is a+b, and the width of the window 26 is narrowed by 2*c* at the tips 31*b* and 31*b*', which is the total height of the protrusions 31 and 31'.

Therefore, the dimension of the window 26 is gradually reduced from the top corners 31*a* and 31*a*' towards the tips, 31*b* and 31*b*'. The window 26 is then gradually enlarged from the turning points, that is, the tips 31*b* and 31*b*' of the protrusions 31 and 31' towards the bottom corners 31*c* and 31*c*'. The width of the window 26 at the top corners 31*a* and 31*a*' is d, the width of the window 26 at the tips 31*b* and 31*b*' is e, and the width of the window 26 at the bottom corners 31*c* and 31*c*' is f. The distance between the tip 31*b* and the edge of the second dielectric layer 24 is h. The width of the top surface 251 of each converging electrode is i, and the width of the bottom surface 252 of each converging electrode is j. The width of the gate conductive layer 23 is k.

The following conditions provide the optimum converging effect:

1. e=g, such that the opening of the converging electrodes equals to the diameter of the electron emission source, that is, the second conductive layer 29 of the cathode electrode layer;

2. d>e, f>e, d≧f; and 3. a:b=0.8 to 1.2.

The condition of e and f larger than e can be achieved by etching, such that the opening area of the converging electrode is minimized, and the electron loss is minimized. By having f>e, the equi-potential lines provide properly converging force to the electron beam. By having d>e, the electron beam is diverged. However, the reduction of the local dimension avoids loss of electrons of the electron beam.

The ratio of a and b is to adjust the focus.

Figure 3:
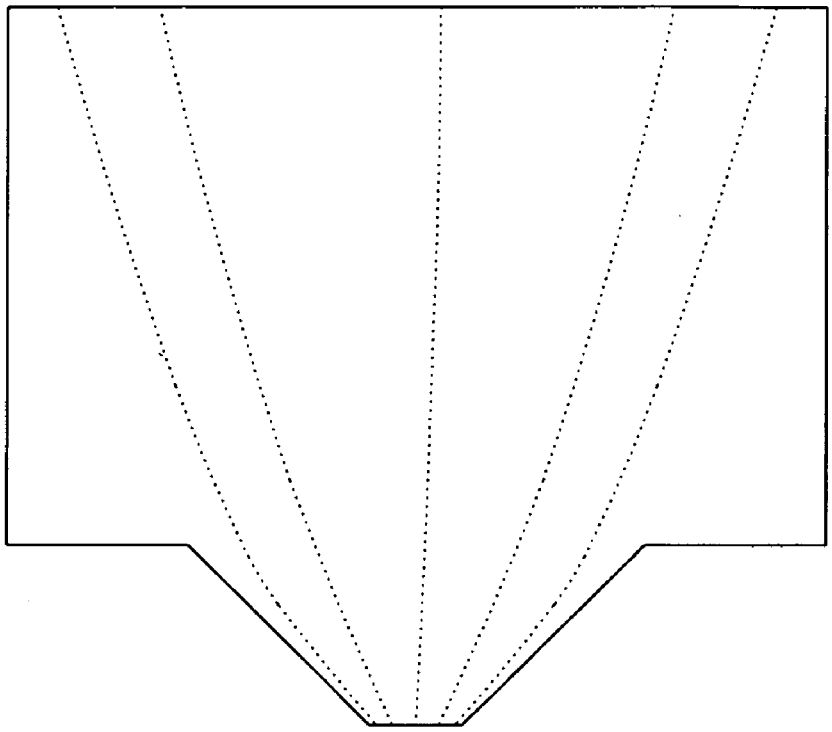
FIG. 3 shows a first embodiment of the emission of the electron beam through the shadow mask converging electrode.

Empirical data shows that, as shown in FIG. 3, when b=0 and a specific voltage is provided to the converging electrode, diverging effect occurs and the converging effect for the electron beam is poor. Thereby, a larger converging voltage is required. However, when an excessive converging voltage is applied, the performance of the gate is replaced by the converging electrode.

Figure 4:
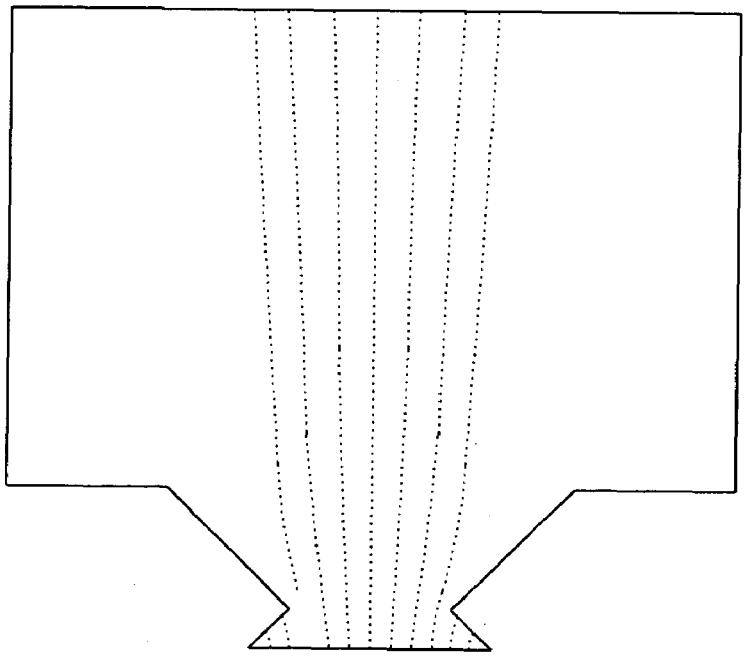
FIG. 4 shows a second embodiment of the emission of the electron beam through the shadow mask converging electrode.

Referring to FIG. 4, the electron beam of the second type of opening of shadow mask opening converging electrode is illustrated. A specific voltage is applied to the converging electrode. When a:b=0.2, converging effect can be obtained. However, the converging effect is obtained with relatively larger converging voltage, such that color effusion occurs.

Figure 5:
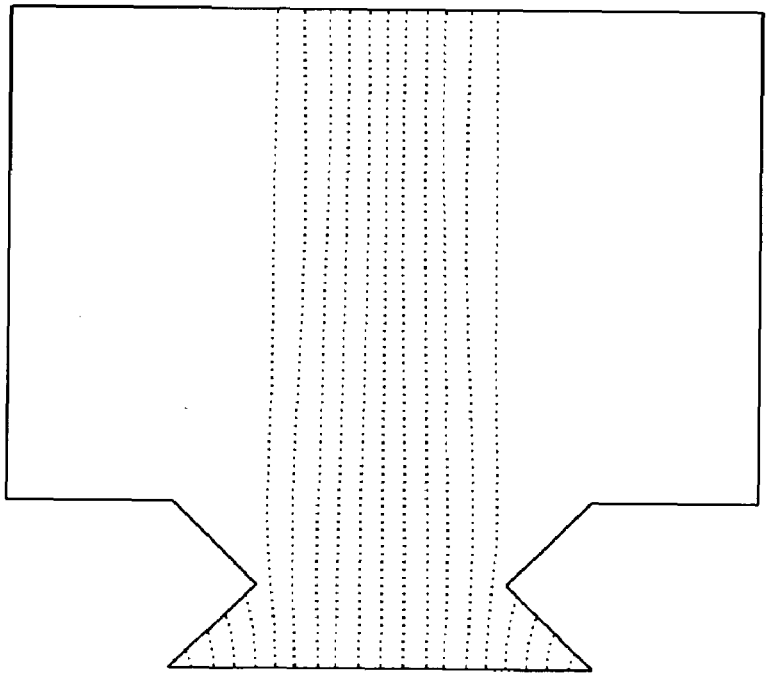
FIG. 5 shows a third embodiment of the emission of the electron beam through the shadow mask converging electrode.

Referring to FIG. 5, the electron beam propagating through another type of opening is illustrated. In FIG. 5, a:b=0.2 to 5. When a specific voltage is applied, the electron beam has a uniform distribution, such that the converging voltage can be controlled for converging the electron beam.

Figure 6:
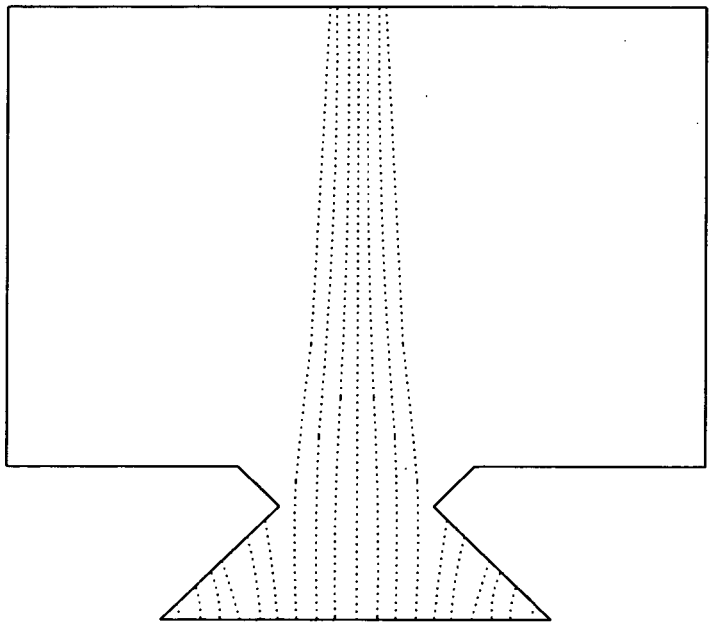
FIG. 6 shows a fourth embodiment of the emission of the electron beam through the shadow mask converging electrode.

In FIG. 6, a:b=8. when a specific voltage is applied, the electron beam is excessively converged, such that the impinging area of the phosphor is too small. Although a small voltage is required for achieving converging effect, the voltage may be too small to be adjusted.

Figure 7:
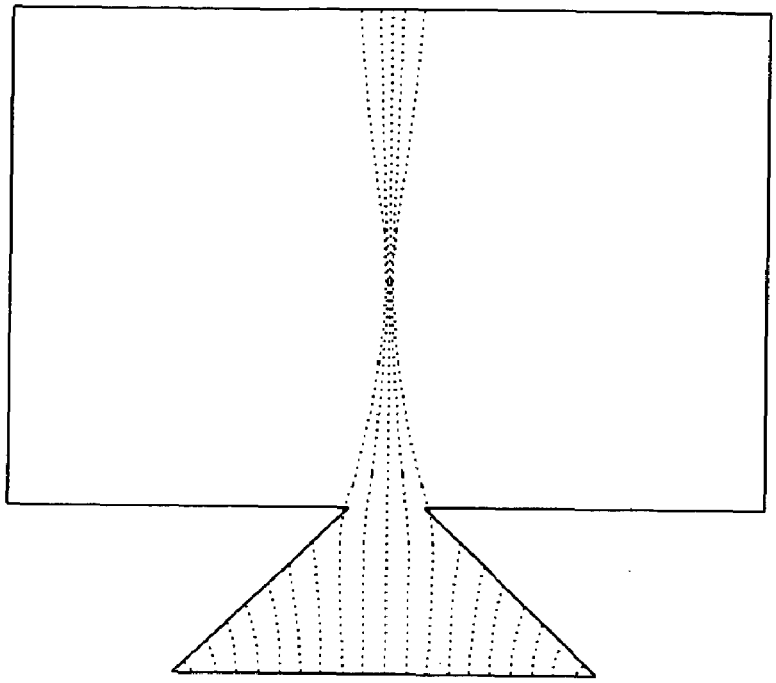
FIG. 7 shows a fifth embodiment of the emission of the electron beam through the shadow mask converging electrode.

In FIG. 7, a=0, such that pre-focus effect occurs to the electron beam, and the donut distribution of impinging area occurs.

Figure 8:
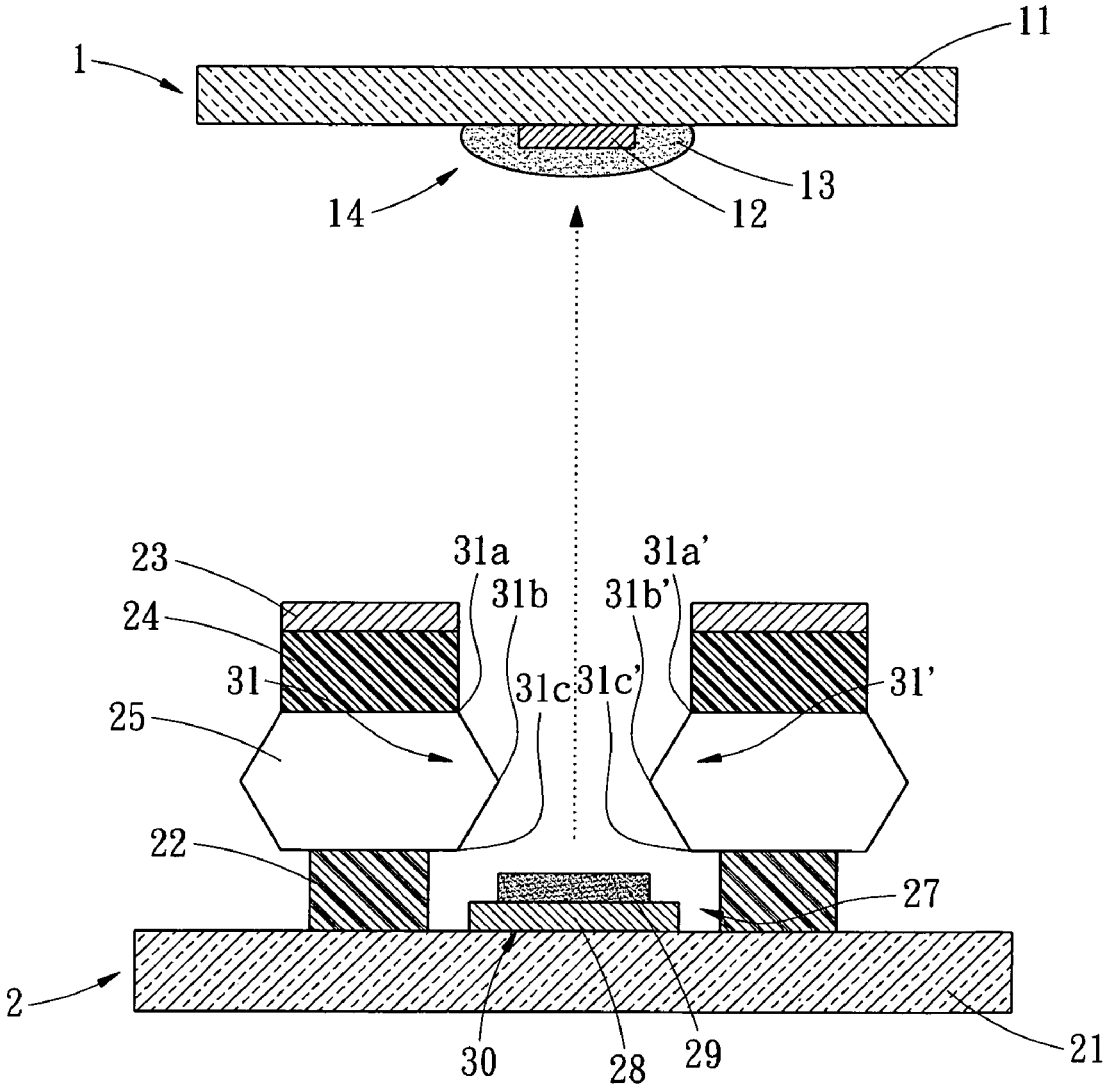
FIG. 8 shows another embodiment of a tetra-polar field-emission display.

In FIG. 8, the bottom surface of the converging electrode is larger than the gate conductive layer 23, such that the gate conductive layer 23 can be formed on the converging layer 25.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A method of fabricating a tetra-polar field-emission display using shadow masking to form an opening of a converging electrode to improve converging effect of an electron beam, comprising:

forming an anode electrode structure; and forming a cathode electrode structure, further comprising:

forming a first dielectric layer, a gate layer, a second dielectric layer and a converging layer on a substrate;

patterning the converging layer, the second dielectric layer, the gate layer and the first dielectric layer to form a window exposing the substrate;

forming a cathode electrode layer on the substrate exposed by the window, including a conductive layer formed on the substrate and a carbon nanotube layer formed on the conductive layer; wherein the converging layer is patterned into a converging electrode having a top surface, a bottom surface, and a pair of side surfaces, the side surfaces are so configured that the window is linearly reduced from the top surface towards a turning point between the top surface and the bottom surface, and then linearly enlarged from the turning point towards the bottom surface, wherein the turning point is lower than the top surface by a first vertical distance and higher than the bottom surface by a second vertical distance, respectively, and a ratio of the first and second vertical distances is controlled for focus adjustment, and wherein the window has a first width at the top surface, a second width at the turning point and a third width at the bottom surface of the converging electrode, and the first width is larger than the third width and the second width is equal to a diameter of the nanotube layer.

2. The method of claim 1, wherein the ratio is between 0.5 to 1.

3. The method of claim 1, wherein the step of forming the anode electrode structure comprises forming an anode electrode layer on a glass substrate.

4. The method of claim 3, further comprising forming a first conductive layer and a second conductive layer as the anode electrode layer.

5. The method of claim 4, further comprising forming the first conductive layer from indium tin oxide.

6. The method of claim 5, further comprising forming the second conductive layer from phosphor.

7. The method of claim 1, further comprising forming the conductive layer from silver paste.

8. A tetra-polar field-emission display, comprising:

an anode structure; and a cathode structure, including:

a pair of stacked electrodes, each of the stacked electrodes comprising a gate electrode and a converging electrode;

a window between the pair of stacked electrodes; and a cathode electrode layer formed within the window, including a conductive layer formed on the substrate and a carbon nanotube layer formed on the conductive layer, wherein the window has a neck portion at a height between a top surface and a bottom surface of the converging electrodes so that the height is controlled to adjust focusing effect of the converging electrode, wherein the converging electrode is so configured that the window has a dimension linearly reduced from the top surface towards the neck portion, and linearly enlarged towards the bottom surface, and wherein the window has a first width at the top surface, a second width at the neck portion and a third width at the bottom surface of the converging electrode, and the first width is larger than the third width and the second width is equal to a diameter of the nanotube layer but smaller than the first and the third widths.

9. The display of claim 8, wherein the converging electrode and the gate layer are higher than the cathode electrode layer.

* * * * *